US008827045B2

(12) United States Patent
Girgis et al.

(10) Patent No.: US 8,827,045 B2
(45) Date of Patent: Sep. 9, 2014

(54) SUSPENSION AND TRACTION MEDIA INTERFACE FOR ELEVATORS

(75) Inventors: Danny William Girgis, Old Bridge, NJ (US); Alessandro Cercone, Woodland Park, NJ (US)

(73) Assignee: Inventio AG, Hergiswil (CH)

( * ) Notice: Subject to any disclaimer, the term of this patent is extended or adjusted under 35 U.S.C. 154(b) by 338 days.

(21) Appl. No.: 12/977,915

(22) Filed: Dec. 23, 2010

(65) Prior Publication Data

US 2012/0160615 A1 Jun. 28, 2012

(51) Int. Cl.
*B66B 7/08* (2006.01)
*B66B 19/00* (2006.01)

(52) U.S. Cl.
CPC ..... *B66B 7/085* (2013.01); *B66B 19/007* (2013.01)
USPC ..... 187/411

(58) Field of Classification Search
CPC ..... B66B 7/08; B66B 7/10
USPC ..... 187/411, 412
See application file for complete search history.

(56) References Cited

U.S. PATENT DOCUMENTS

| | | | | |
|---|---|---|---|---|
| 1,418,089 | A * | 5/1922 | Lindquist | 187/412 |
| 2,089,143 | A * | 8/1937 | White | 187/412 |
| 6,250,608 | B1 * | 6/2001 | Ridley | 254/415 |
| 7,665,580 | B2 | 2/2010 | Stocker et al. | |

* cited by examiner

*Primary Examiner* — Michael Mansen
*Assistant Examiner* — Diem Tran
(74) *Attorney, Agent, or Firm* — Fraser Clemens Martin & Miller LLC; William J. Clemens

(57) ABSTRACT

A system for coupling a suspension medium to a load carrying structure of an elevator installation includes a frame and a hitch plate. The frame has two spaced apart side walls, wherein the side walls are positionable to receive a part of the load carrying structure between the side walls. Each side wall has a receptacle having a longitudinal shape. The hitch plate has at least one fixture configured to couple to a sheave arrangement for the suspension medium. Each receptacle is sized to movably receive a section of the hitch plate so that the hitch plate extends between the side walls and is rotatable about a vertical axis.

20 Claims, 6 Drawing Sheets

SUSPENSION AND TRACTION MEDIA INTERFACE FOR ELEVATORS

BACKGROUND OF THE INVENTION

The various embodiments described herein generally relate to elevator installations. More particularly, the various embodiments described herein relate to a system and method for coupling a suspension medium to a load carrying structure of an elevator installation.

In one example of a known elevator installation, a suspension medium—such as a rope or flat belt-type rope—interconnects a counterweight and a cabin. A drive motor causes the suspension medium to move in order to thereby move the counterweight and the cabin up and down along a hoistway. The suspension medium loops around at least one sheave system, which may be mounted to the cabin or the counterweight, or both. The sheave system is, for example, mounted a frame of the cabin.

U.S. Pat. No. 7,665,580 discloses several sheave systems arranged next to each other on the counterweight or the cabin. Each sheave system has a U-shaped carrier in which a deflecting roller and a ball socket are positioned. The deflecting roller is mounted between the legs of the U-shaped carrier, and the ball socket exists in a curve that connects the two legs. A flat belt-type suspension medium loops around the deflecting roller. A tie bolt is part of the ball socket and extends from the carrier towards a support structure of the counterweight or cabin. The tie bolt is fixed in a through hole of the support structure. Further, each sheave system is individually rotatable and adjustable about an axis parallel to a take-off direction of a respective suspension medium.

Even though such sheave systems have a variety of advantages, for example, because they are individually rotatable, these sheave systems may not be suitable for certain applications. For example, if an elevator installation is subject to modernization and the existing cabin frame and counterweight are to be retained without any modification, it may not be possible to provide the frame with, for example, the required through holes for the tie bolts, or to adjust the sheave system for varying hoistway layouts. There is, therefore, a need for an alternative technology for coupling a suspension medium to a cabin or counterweight that overcomes these limitations.

SUMMARY OF THE INVENTION

Accordingly, on aspect of such an alternative technology involves a system for coupling a suspension medium to a load carrying structure of an elevator installation. The system includes a frame and a hitch plate. The frame has two spaced apart side walls, wherein the side walls are positionable to receive a part of a yoke of the load carrying structure between the side walls. Each side wall has a receptacle having a longitudinal shape. The hitch plate has a least one fixture configured to couple to a pulley device for the suspension medium. Each receptacle is sized to movably receive a section of the hitch plate so that the hitch plate extends between the side walls and is rotatable about a vertical axis.

Another aspect involves an elevator installation having a suspension medium, a sheave arrangement, coupled to the suspension medium, a load carrying structure, and a coupling system configured to couple the sheave arrangement to the load carrying structure. The coupling system includes a frame and a hitch plate. The frame has two spaced apart side walls, wherein the side wails are positionable to receive a part of a yoke of the load carrying structure between the side walls.

Each side wall has a receptacle having a longitudinal shape. The hitch plate has a least one fixture configured to couple to a pulley device for the suspension medium. Each receptacle is sized to movably receive a section of the hitch plate so that the hitch plate extends between the side walls and is rotatable about a vertical axis.

Yet another aspect involves a method of coupling a suspension medium to a load carrying structure of an elevator system. A hitch plate is positioned above a part of the load carrying structure, and sidewalls are mounted to the hitch plate so that sections of the hitch plate are rotatably positioned in receptacles of the sidewalls and the part of the load carrying structure extends between the sidewalls. The sidewalls are opposite each other and extend in parallel planes. Further, a sheave arrangement is mounted to the hitch plate, wherein the sheave arrangement is configured to receive the suspension medium.

In one embodiment, the plate has a circular shape. The circular shape allows the hitch plate to be adjusted to a desired angle in a range between about 0° and about 360°. This provides for a high flexibility and usability of the system.

Sections of the circularly shaped hitch plate extend through the receptacles of the hitch plate. Such a mounting of the side walls to the hitch plate provides for a secure engagement between these components that can be easily verified and inspected by an installer.

The at least one fixture of the hitch plate includes an opening sized to receive a rod of the pulley arrangement. Advantageously, this allows the pulley arrangement to be mounted "from above", i.e., in vertical direction, while the coupling system is already mounted to the load supporting structure, which also facilitates the installation procedure. In one exemplary embodiment described herein, a plurality of the openings is positioned along a straight line. That linear arrangement of the openings corresponds to the arrangement of the suspension media in the elevator shaft facilitating their alignment with the coupling system.

In one embodiment, a predetermined number of longitudinal elements extends between the side walls and interconnects the side walls. Each side wall has a corresponding number of passageways, each removably receiving an end section of the longitudinal element. This assists in assembling the coupling system "element-by-element" around the load carrying structure.

Furthermore, each side wall has an upper part containing the receptacle, and a bottom part having an opening for a crossbeam. The crossbeam, or a group of crossbeams, are thereby secured to the coupling system and carry the load carrying structure.

In one embodiment, first setscrews extends through the hitch plate and are configured to press against an upper surface of the support structure for vertical positioning of the coupling system with respect to the load carrying structure. Second setscrews extend through the side walls to press against sides of the load carrying structure for horizontal positioning of the coupling system. These two sets of setscrews allow the separate alignment of the coupling system with respect to the load carrying structure, which also assists in facilitating the installation procedure.

Each setscrew may have a bearing surface pressing against the load carrying structure that includes a material that dampens vibrations. Advantageously, the bearing surface prevents (or at least dampens) vibrations from propagating into the load carrying structure and the cabin.

BRIEF DESCRIPTION OF THE SEVERAL VIEWS OF THE DRAWINGS

The novel features and method steps characteristic of the invention are set out in the claims below. The invention itself, however, as well as other features and advantages thereof, are best understood by reference to the detailed description, which follows, when read in conjunction with the accompanying drawings, wherein:

DETAILED DESCRIPTION OF THE INVENTION

Figure 1:
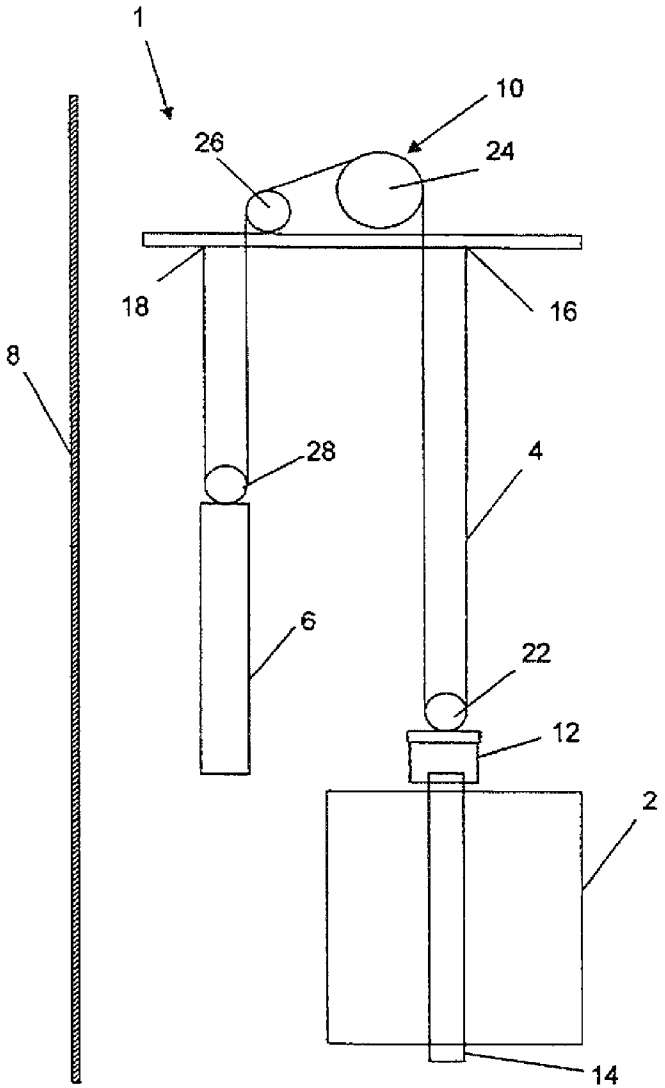
FIG. 1 shows a schematic illustration of one embodiment of an elevator installation with a sheave arrangement and a system for coupling a suspension medium to a load carrying structure.

FIG. 1 schematically illustrates one embodiment of an elevator installation 1 installed in a multi-story building. The elevator installation 1 includes a cabin 2 connected by a suspension medium 4 with a counterweight 6, wherein the cabin 2 and the counterweight 6 are movable up and down in opposite directions in a vertically extending shaft 8. A drive 10 is provided below a shaft roof and next to a structure 20. Depending on whether the elevator installation 1 is provided with or without a machine room, the structure 20 may be a floor of a separate machine room, which houses the drive 10, or a support structure provided below the shaft roof; a space below the shaft roof is sometimes referred to as an overhead space. In the latter situation, the structure 20 is mounted to a shaft wall to support the drive 10 in proximity of the shaft wall.

The drive 10 is configured to drive the suspension medium 4 to move the cabin 2 and the counterweight 6. In one embodiment, the elevator installation 1 is a traction-type elevator, i.e., a drive sheave coupled to the drive 10 acts upon the suspension medium 4 by means of traction between the drive sheave and the suspension medium 4. In such an embodiment, the suspension medium 4 serves as a suspension and traction medium.

The elevator installation 1 includes further a load carrying structure 14 that carries the cabin 2. The load carrying structure 14—also referred to as "sling"—includes a yoke, crosshead, or frame that at least partially surrounds the cabin 2. The cabin 2, empty or loaded with goods or passengers, constitutes a load to be carried by the load carrying structure 14. It is contemplated that the cabin 2 includes at least one door on one side of the cabin 2; however, for ease of illustration, FIG. 1 does not show a door or any other component of the cabin 2.

A system 12 for coupling the suspension medium 4 to the load carrying structure 14 interfaces the load carrying structure 14 and the suspension medium 4. This system is hereinafter also referred to as coupling system 12. It is contemplated that the coupling system 12 may be provided at the counterweight 6 to interface the counterweight 6, or a frame of the counterweight 6, and the suspension medium 4. The elevator installation 1, therefore, may have the coupling system 12 at the load carrying structure 14 or the counterweight 6, or both.

In the illustrated elevator installation 1 of FIG. 1, terminal ends of the suspension medium 4 are fixed at fix points 16, 18 to the structure 20. Starting at the fix point 16, the suspension medium 4 extends downwards, loops around a sheave arrangement 22 of the system 12 and extends upwards towards the drive 10. There, the suspension medium 4 loops around a drive sheave 24 of the drive 10 and extends towards a deflection roller 26 positioned next to the drive 10 above the structure 20. The deflection roller 26 guides the suspension medium 4 sideways so that the up and down movement of the counterweight 6 does not interfere with the up and down movement of the cabin 2. At the deflection roller 26, the suspension medium 4 extends downwards, loops around a sheave 28 at the counterweight 6 and extends upwards towards the fix point 18. This configuration of the suspension medium 4 is typically called a 2:1 configuration. It is contemplated that in other embodiments of the elevator installation 1 other configurations, e.g., 1:1 or 4:1, may be used; the number of sheaves, rollers and fix points may then vary depending on a particular embodiment.

Independent of any particular roping configuration or structure of the elevator installation 1, the suspension medium 4 may have one of several configurations. In one embodiment, the suspension medium 4 has a belt-type configuration in which several cords of metallic material are fully or partially embedded in an elastomeric coating. That configuration has a cross-section having a width that is longer than its height. The surface of such a suspension medium 4 may be flat or have longitudinal grooves. In another embodiment of a suspension medium 4 with such a cross-section, cords of non-metallic material, such as aramid fibers, are fully or partially embedded in an elastomeric material. In yet another embodiment, the suspension medium 4 may have a round configuration in which individual cords of metallic or non-metallic material are twisted to a rope. Such a round suspension medium may be uncoated or coated with an elastomeric material.

It is contemplated that the elevator installation 1 may in certain embodiments include more than one suspension medium 4. The number of suspension media 4 used in the elevator installation 1 depends, for example, on the load capacity of the cabin 2. In the embodiments described with respect to FIG. 4-7, the elevator installation 1 includes five suspension media 4, each having a belt-type configuration, as defined above. The number of suspension media 4 affects the number of sheaves and rollers used in the elevator installation 1. Each sheave and roller acts typically on only one suspension medium 4.

Figure 2:
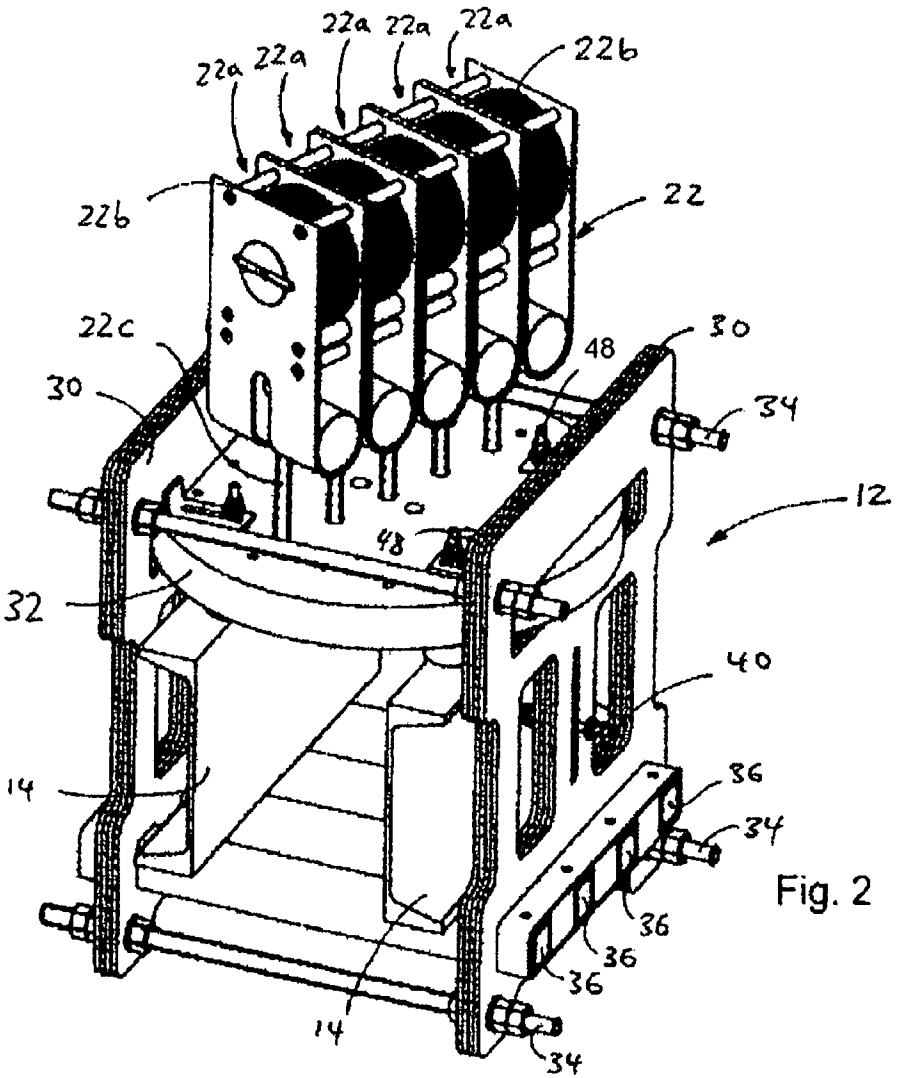
FIG. 2 is a schematic illustration of one embodiment of the sheave arrangement and the system for coupling the suspension medium to the load carrying structure shown in FIG. 1.

FIG. 2 is a schematic illustration of one embodiment of the sheave arrangement 22 and the coupling system 12 shown in FIG. 1. As the number of suspension media 4 is five, the sheave arrangement 22 includes five individual sheaves 22*a*. These individual sheaves 22*a* are arranged in parallel, and may be positioned at an angle that is not perpendicular to the linear arrangement of a hole pattern in a hitch plate 32 (described below with reference to FIGS. 3 and 6). Each individual sheave 22*a* includes a U-shaped housing with a sheave roller 22*b* mounted between the legs of the U-shaped housing. The suspension medium 4 loops around the sheave roller 22*b*. A tie bolt 22*c* is part of the ball socket and extends from the housing towards the coupling system 12. The sheave arrangement 22 is in one embodiment similar to the sheave system disclosed in U.S. Pat. No. 7,665,580 and described above.

Figure 3:
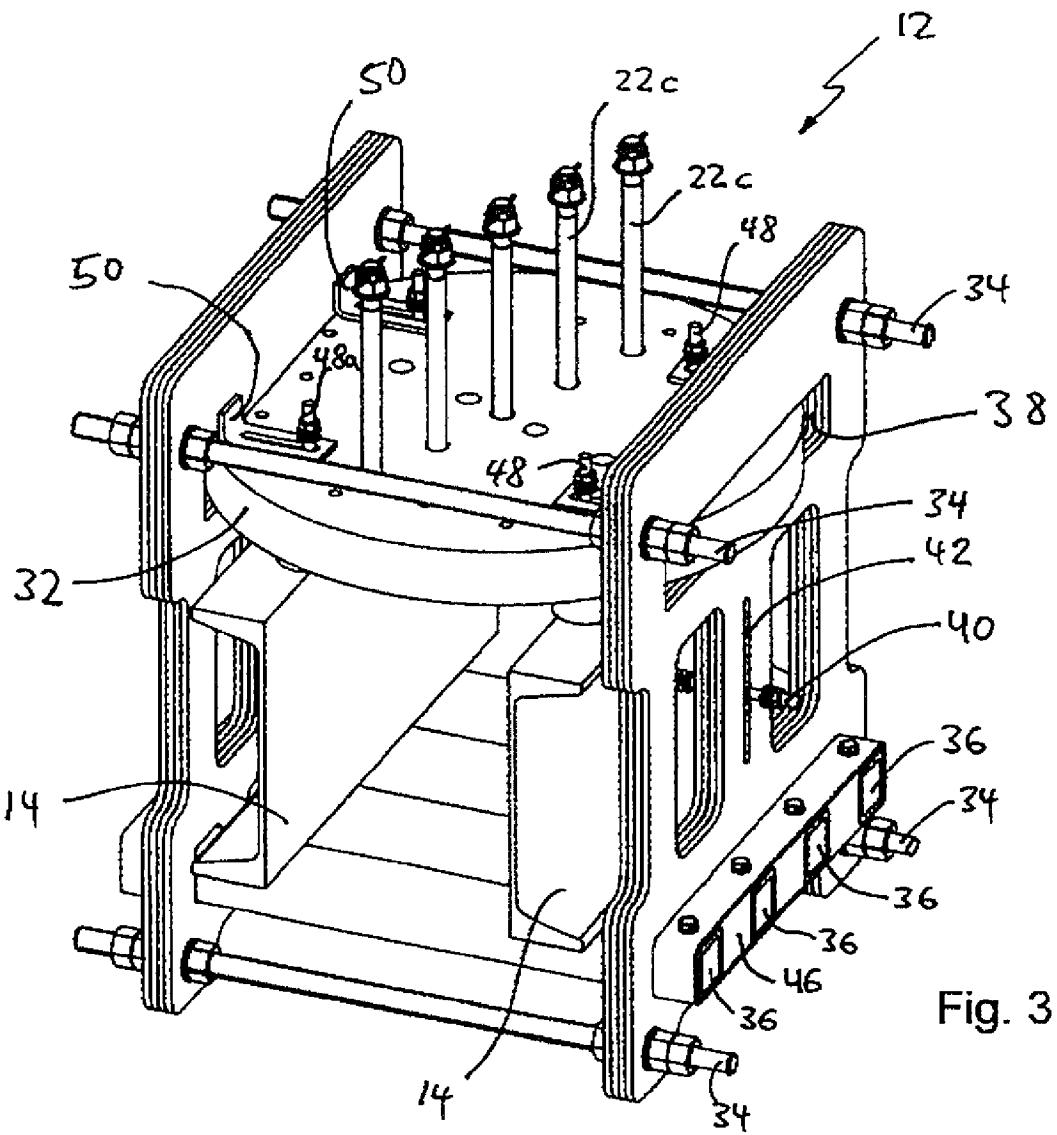
FIG. 3 is a schematic illustration of one embodiment of the system for coupling the suspension medium to the load carrying structure shown in FIG. 2.

Referring to FIG. 2 and FIG. 3, which shows the coupling system 12 of FIG. 2 without the sheave arrangement 22, the coupling system 12 includes a frame that has two spaced apart side walls 30, which extend in parallel planes. The side walls 30 are positionable to receive a part of a yoke of the load carrying structure 14 (in FIG. 2 indicated by dashed lines) between the side walls 30. The side walls 30 are substantially parallel to each other. Each side wall 30 has a receptacle 38. In the illustrated embodiment, each receptacle 38 has a longitudinal shape. Rods 34 interconnect the side walls 30 and, hence, allow positioning the yoke between the side walls 30. The rods 34 extend in a direction that is substantially perpendicular to the parallel planes of the side walls 30, and allow the side walls 30 to adjust to be securely fixed around a width of the load carrying structure 14.

As shown, e.g. in FIG. 2, each side wall 30 has a generally rectangular shape, wherein through holes for the rods 34 are located in corners of the rectangular shape. In the illustrated embodiment, the coupling system 12 includes four rods 34, each having a circular cross section. However, it is contemplated that more or less rods 34 may be used, or that the rods 34 may have a different profile, e.g. a non-circular cross section, as long as the rods 34 allow the secure positioning of the yoke between the side walls 30.

The coupling system 12 includes a hitch plate 32 that extends between the side walls 30 in a direction that is substantially perpendicular to the planes of the side walls 30. Each receptacle 38 of the side walls 30 is sized to movably receive a section of the hitch plate 32 so that the hitch plate 32 extends between the side walls 30 and is rotatable about a vertical axis. The receptacle 38 allows the hitch plate 32 to be rotated 360° into any position necessary for a correct alignment of the suspension medium 4. The receptacle 38 and may have another shape as long as it secures the hitch plate 32 and allows rotation of the hitch plate 32. The hitch plate 32 has a least one fixture configured to couple to the pulley arrangement 22. The fixture includes in one embodiment a through hole for the tie bolt 22*c*. In the illustrated embodiment, the hitch plate 32 has five through holes to receive the five tie bolts 22*c*. It is contemplated that not all through holes of the hitch plate 32 must be used; in the illustrated embodiment up to five tie bolts 22*c* may be used, others may use less than five.

In the various embodiments described herein, the hitch plate 32 and the receptacles 38 are located in proximity of an end of each side wall 30. This end of each side wall 30 is hereinafter referred to as upper end, whereas an opposing end of each side wall 30 is referred to as bottom end. The reference to upper and bottom ends corresponds to the orientation of the coupling system 12 within the shaft 8, and the up and down movements of the cabin 2.

In proximity of the bottom ends, each side wall 30 has at least one opening 46 configured to receive a crossbeam 36. The crossbeam 36 extends through the openings 46 of each side wall 30 substantially parallel to the hitch plate 32 and in a direction perpendicular to the side walls 30. The crossbeam 36 is secured at the openings 46, e.g., by means of nuts and bolts, or any other means, against unintended movement. In the illustrated embodiment, the coupling system 12 includes four crossbeams 36. However, it is contemplated that the number of crossbeams 36 may vary, e.g., due to varying load requirements of a particular elevator installation 1.

The arrangement of the side walls 30, rods 34, hitch plate 32 and crossbeams 36 results in a frame structure having an opening with a substantially rectangular cross section. This opening of the coupling system 12 is sized to receive the yoke of the support structure 14. As shown in FIG. 2 and FIG. 3, the hitch plate 32 is located above the yoke, and the crossbeams 36 are located below the yoke. In use, the yoke and the crossbeams 36 press against each other, e.g., the crossbeams 36 carry the load supporting structure.

Figure 4:
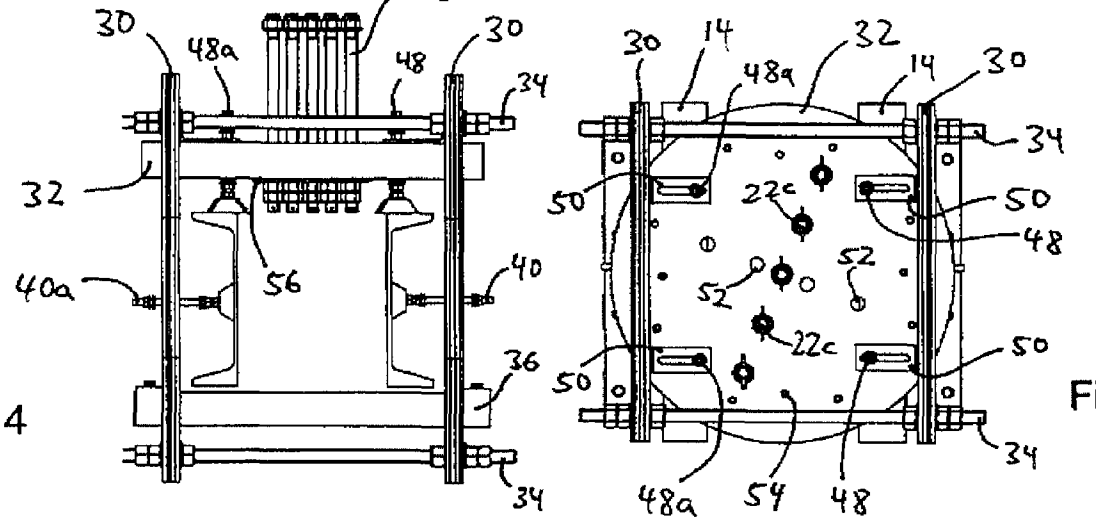
FIGS. 4 and 5 are schematic side views of the system for coupling the suspension medium to load carrying structure of FIG. 3.

To secure and/or to adjust the position of the yoke within the opening, the coupling system 12 includes set screws 40, 40*a*, 48, 48*a* that press against the yoke, as shown in FIG. 4. Each side wall 30 has an opening 42 through which a set screw 40 (40*a*) extends, as illustrated in, e.g., FIG. 2 were only one opening 42 is visible. In the illustrated embodiment, the opening 42 is a vertical slot to allow vertical alignment of the set screw 40 with respect to the yoke. The set screws 40, 40*a* press against side walls of the yoke, and allow the coupling system 12 to be adjusted with respect to the yoke of the load carrying structure 14. The set screws 48, 48*a* extend, e.g. via through holes, through the hitch plate 32, and press against upper surfaces of the yoke. Angle elements 50 are mounted to the side walls 30 and have a generally L-shaped form. The short legs of the angle elements 50 are mounted to the side walls 30, and the long legs each have a longitudinal slot sized to receive the set screws 48, 48*a*. The long legs are substantially parallel to an upper surface of the hitch plate 32. The set screws 48, 48*a* are movable within the longitudinal slots to allow horizontal positioning of the hitch plate 32.

FIGS. 4-7 are schematic plan views (cross-section, side view, top view, bottom view) of the coupling system 12 of FIG. 3. The cross-section of FIG. 4 shows the rectangular opening of the coupling system 12 and the positioning of the yoke within that opening. The hitch plate 32 extends on both sides through the side walls 30. The set screws 40, 40*a* extend through the side walls 30, and the set screws 48, 48*a* extend through the hitch plate 32, all of which press against the yoke. The purpose of the setscrews 40, 40*a*, 48, 48*a* is to fix the position of the coupling system 12 in relation to the yoke of the support structure 14 so that, e.g., in case the suspension media 4 ever becomes slack (such as in a buffer strike or safety set), the coupling system 12 will not move from its initial installed position along the yoke of the support structure 14. Each set screw 40, 40*a*, 48, 48*a* has a cup shaped bearing surface that interacts with the yoke. The bearing surface may be of a material (e.g., a plastic material, or a rubber material) that is hard enough to provide for the fixing of the position of the coupling system 12, but is also sufficiently soft to dampen vibrations; advantageously vibrations from the suspension media 4 do not, or at least at a reduced magnitude, propagate into the yoke and, therefore, not into the cabin 2. The remaining part of each set screw 40, 40*a*, 48, 48*a* is made of metal.

In proximity of the bearing surface, each set screw 40, 40*a*, 48, 48*a* has a pair of (counter) nuts to allow adjusting and fixing the length of the set screw 40, 40*a*, 48, 48*a* extending from the underside of the hitch plate 32. The tie bolts 22*c* extend through the hitch plate 32, wherein each tie bolt 22*c* has in proximity of the bearing surface a pair of nuts to allow adjusting and fixing the tie bolt 22*c*. In the illustrated embodiment, an optional washer plate 56 may be positioned between the underside of the hitch plate 32 and the nuts. It is contemplated that instead on using such a single longitudinal washer plate, individual washers may be used.

Figure 5:
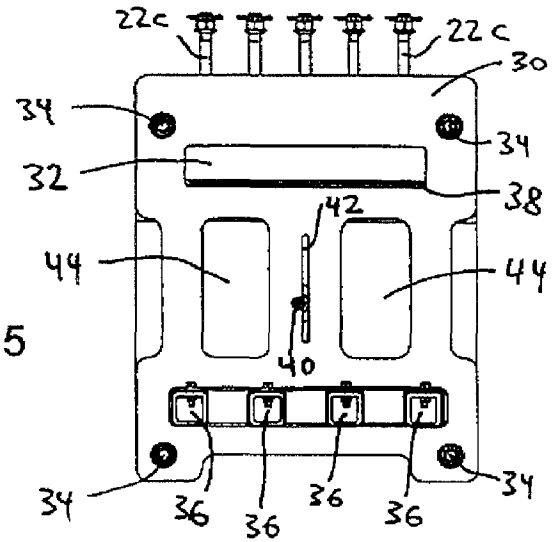

The side view of FIG. 5 shows the arrangement of the crossbars 36 within the opening 46 of the side wall 30. In the illustrated embodiment, the crossbars 36 are equally spaced. In other embodiments, however, the spacing may be different. The illustrated embodiment of the side wall 30 has additional openings or cutouts 44 to minimize the weight of the side wall 30. However, it is contemplated that in other embodiments the side wall 30 does not have such openings or cutouts 44.

Figure 6:
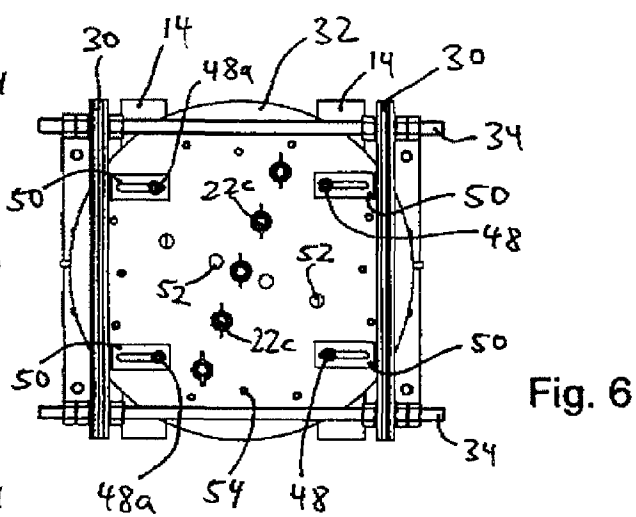
FIG. 6 is a schematic top view of the system for coupling the suspension medium to load carrying structure of FIG. 3.

The top view of FIG. 6 illustrates that the hitch plate 32 has a preset pattern of through holes. The tie bolts 22*c* are arranged in a line that extends at an angle with respect to the side walls 30. The angle may be adjusted between about 0° and about 360° depending on a particular embodiment. In addition to the through holes for the tie bolts 22*c*, the hitch plate 32 has additional through holes 52 which are arranged in a line that extends perpendicular to the line along which the tie bolts 22*c* are arranged. The difference between the line of through holes 52 and the line of through holes in which tie bolts 22*c* are arranged, is that the line of through holes 52 has an even number of equally spaced holes for use when the number of suspension media is 2 or 4, and the line of through holes in which tie bolts 22*c* are arranged have an odd number of equally spaced holes for use when one, three, or five suspension media 4 are used. In the embodiment of FIG. 3, this hitch plate 32 may be used when the number of suspension media 4 is five or less. That is, a single hitch plate 32 can be used for up to five suspension media 4. It is also contemplated that if more than five suspension media 4 are necessary, a similar but larger hitch plate with more through holes can be used. A further line of through holes 52 may be provided as well. This further line of through holes 52 may be provided at any desired angle. The hitch plate 32 may have other through holes 54 which are arranged along the border of the hitch plate 32 and configured to align with the angle elements 50. These additional through holes 52, 54 provide for additional flexibility when positioning the hitch plate 32.

The hitch plate 32 has a circular shape of a predetermined diameter and thickness. In one embodiment, its diameter is about 500 mm and its thickness is between about 50 mm and about 60 mm, e.g., about 50.8 mm. For such a hitch plate 32, the side walls 30 are spaced at a distance between about 100 mm and about 350 mm and have a height between about 450 mm and about 580 mm, e.g., about 453 mm and about 574 mm. The hitch plate 32 is made of steel, e.g., low carbon steel, or any other material that has a sufficient mechanical strength to support the forces occurring during typical load conditions plus a predetermined safety factor. It is contemplated, that the hitch plate material, diameter and thickness and number of through holes may be selected according to load requirements. The same applies to the spacing of the side walls 30 and their heights. Advantageously, hitch plate 32 allows for rotation of about 360°. Other shapes may have a reduced range of rotation.

Figure 7:
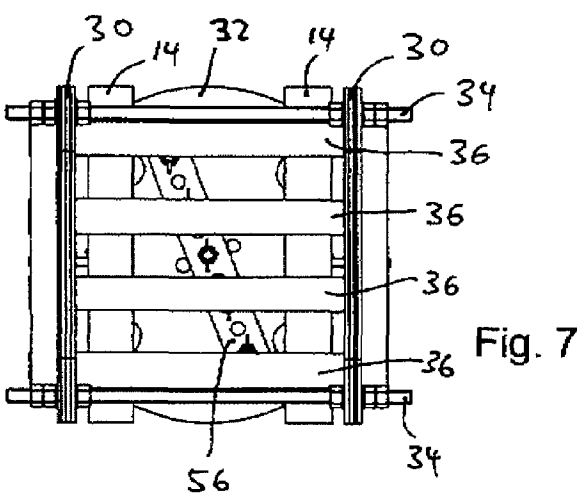
FIG. 7 is a schematic bottom view of the system for coupling the suspension medium to load carrying structure of FIG. 3.

The bottom view of FIG. 7 shows again the arrangement of the crossbeams 36 and the washer plate 56 mentioned with reference to FIG. 4. A pair of (bottom) rods 34 extends underneath the crossbeams 36, as shown in FIG. 7, and a pair of (upper) rods 34 extends above the hitch plate 32, as shown in FIG. 6. Once adjusted, the rods 34 are secured to the side walls 30, e.g., by means of nuts screwed onto threaded end sections of the rods 34, or any other fastening means.

Having described various embodiments of the coupling system 12 and the sheave arrangement 22, the following describes a method of coupling a suspension medium 4 to the load carrying structure 14. Briefly, the hitch plate 32 is positioned above a part of the load carrying structure 14, and the side walls 30 are mounted to the hitch plate 32 so that sections of the hitch plate 32 are rotatably positioned in receptacles 38 of the side walls 30 and the part of the load carrying structure 14 extends between the side walls 30. The side walls are opposite each other and extend in parallel planes. Further, the sheave arrangement 22 is mounted to the hitch plate 32, wherein the sheave arrangement 22 is configured to receive the suspension medium 4.

Figure 8:
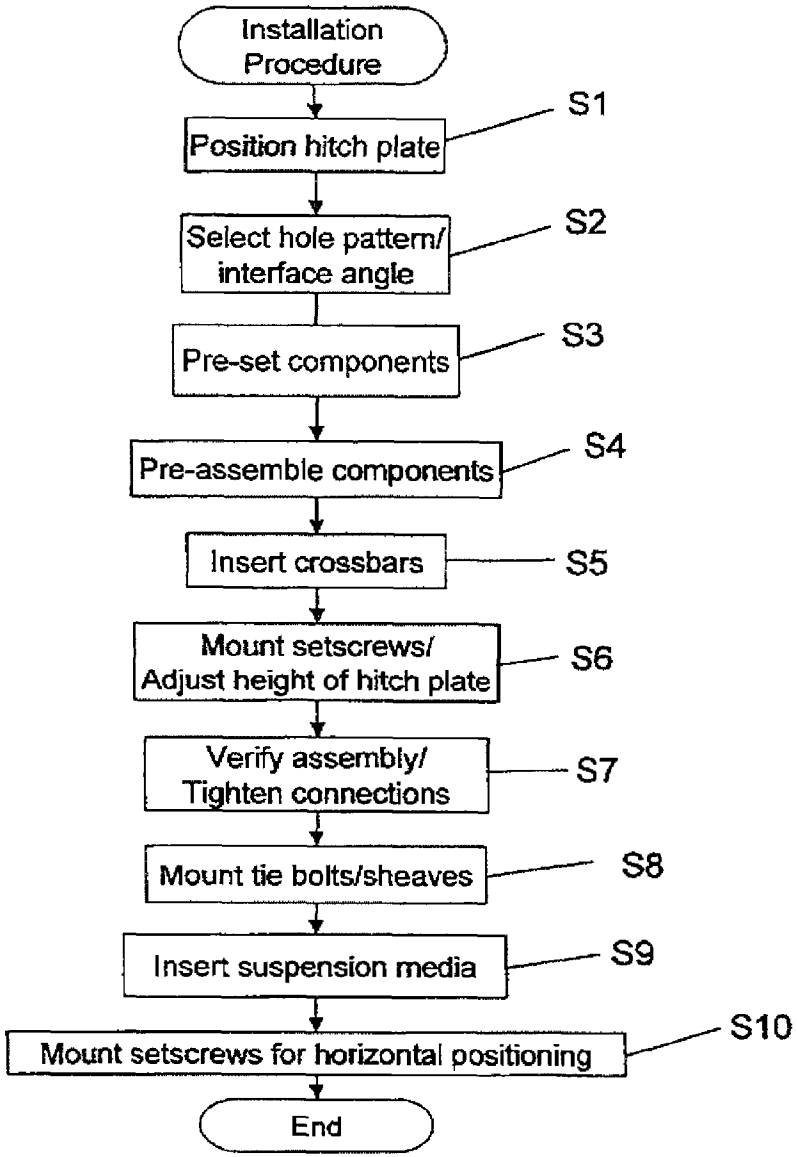
FIG. 8 is a flowchart of one embodiment of procedure for installing the system for coupling the suspension medium to load carrying structure.

Referring to a more detailed description, FIG. 8 is a flowchart of one embodiment of a procedure for installing the coupling system 12 and the sheave arrangement 22. The procedure may be performed during modernization of an elevator installation, e.g., by an installer working on the roof of the cabin 2. The cabin 2 has been secured by anchoring the support structure 14 at the guide rails, and, in case of a modernization project, any existing suspension medium, e.g., has been removed.

In a step S1, the hitch plate 32 is positioned above the yoke (or crosshead). The hitch plate 32 may be hoisted and/or anchored above the yoke, e.g., centered along the length of the yoke.

In a step S2, the required hole pattern is selected and an interface angle is determined. The interface angle is the angle at which the hitch plate 32 is to be placed for a correct alignment of the suspension medium 4, i.e., to offset any twist in the suspension medium 4 between the cabin 2 and the counterweight 6. In one embodiment, the hole pattern shown in FIG. 6, i.e., five suspension media 4 in a row, is selected.

Figure 10:
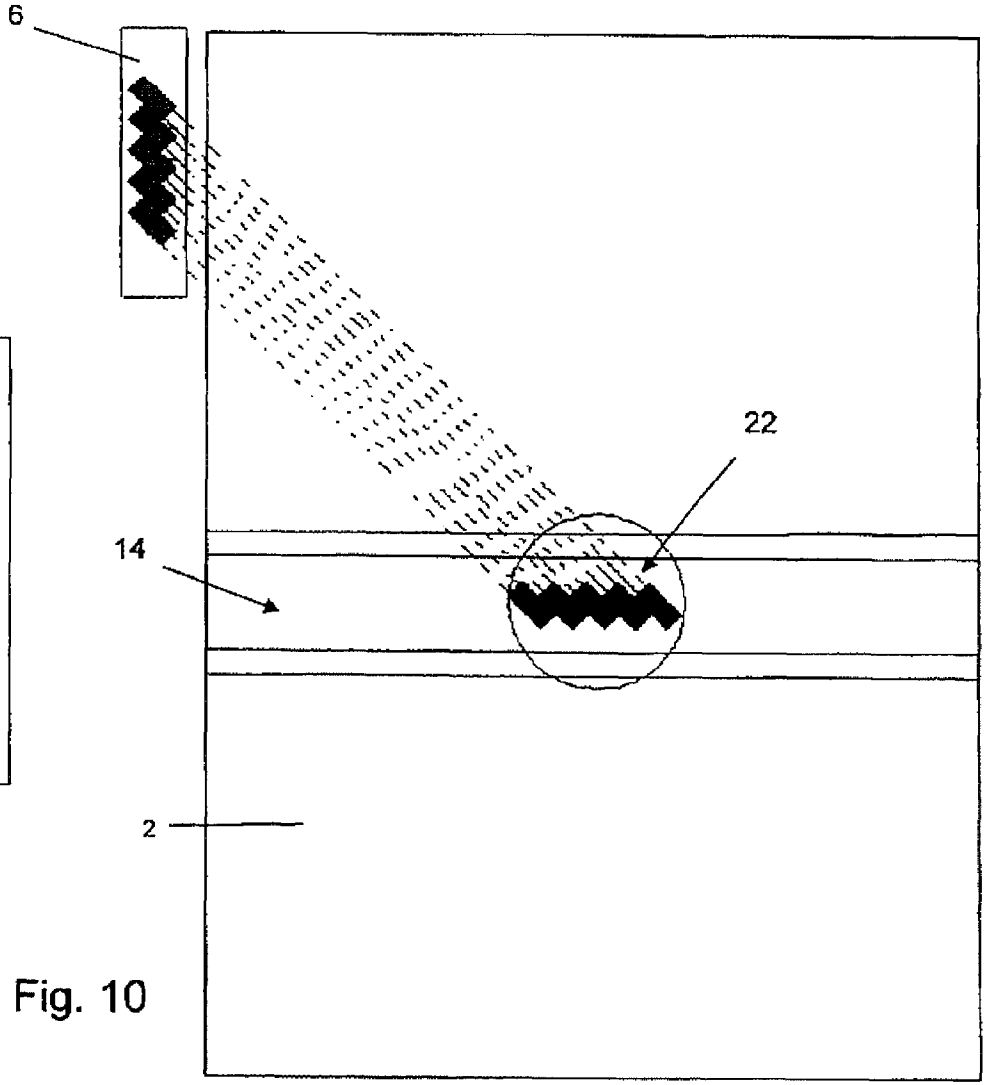
FIG. 10 schematically illustrates the arrangement of FIG. 9 skewed from being perpendicular.
Figure 9:
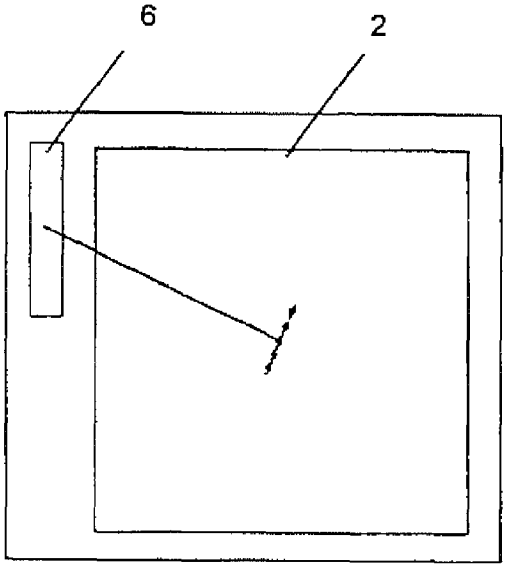
FIG. 9 schematically illustrates an arrangement of a sheave arrangement set up perpendicular to a line that connects a cabin centerline with a counterweight centerline.

The interface angle is dependent on the location of the counterweight 6 in the hoistway, and the position of the drive 10 (bedplate), e.g., in the machine room. Typically, the linear sheave arrangement 22 is set up perpendicular to a line that connects a centerline of the cabin 2 with a centerline of the counterweight 6, as shown in the top view illustration of FIG. 9. However, for some installations, this is not possible, and the linear arrangement is skewed from being perpendicular, as shown in the top view illustration of FIG. 10. In these cases, each sheave 22*a* in the particular sheave arrangement 22 is rotated so that the (flat, belt-type) suspension media 4 is sufficiently parallel to an imaginary line connecting the cabin and counterweight centerlines. The optimal interface angle is a combination of the angle the through holes in the hitch plate 32 makes with the yoke, and the angle each individual sheave 22*a* is set at so that smallest amount of twist is imparted to the flat suspension media 4. The determined interface angle may not be the final angle; it is contemplated that the hitch plate 32 can be rotated and fine tuned at any time during the installation procedure.

In a step S3, components of the coupling system 12 are pre-set. A side wall 30 is placed on each side of the yoke, and nuts and washers are attached on each side of each rod 34 to set an absolute minimum width of the distance between the side walls 30. These sides of the rods 34 have in one embodiment threaded portions. When installed, these nuts and washers are placed on inner sides of the side walls 30, as shown, e.g., in FIG. 3. The side walls 30 should be positioned symmetrically to the center of the hitch plate 32. The nuts and washers placed on the rods 34 are adjusted on the rods 34 as needed to achieve that positioning.

In a step S4, the components of the coupling system 12 are pre-assembled. The side walls 30 are initially loosely fitted around the yoke with the hitch plate 32 inserted into the openings 38 of the side walls 30. One way of achieving that initial fitment is to insert the hitch plate 32 into the opening 38 of one side wall 30, insert the rods 34 into their respective holes of that side walls 30, and to place the second side wall 30 onto the rods 34 with the hitch plate 32 inserted into the opening 38 of that side wall 30.

In a step S5, the crossbars 36 are inserted into the opening 46 of each side wall 30. The crossbars 36 may be secured within the opening 46 of one side wall 30.

In a step S6, the setscrews 48, 48*a* are mounted to the hitch plate 32. The setscrews 48, 48*a* are adjusted to rest on the surface of the yoke. The height of the hitch plate 32 is adjusted to ensure proper fitment beneath the yoke for the crossbars 36. The setscrews 48, 48*a* are then adjusted for proper fitment of the hitch plate 32 above the yoke.

As mentioned above, each side wall 30 may be formed by four individual plates. In such an embodiment, these plates can now mounted to the rods 34 on each side of the yoke.

In a step S7, once proper fitment has been verified, the assembly is verified and all screw connections are tightened. It is then again verified that a tight fitment has been made without any risk of play, that the hitch plate 32 is centered and secured in the openings 38 of the side walls 30. In one embodiment, the hitch plate 32 sticks out at least about 31.75 mm further than an outer side of the side walls 30.

In a step S8, the tie bolts 22*c* together with the sheaves 22*a* are mounted to the hitch plate 32 and secured on the underside of the hitch plate 32 through nuts and split pins. Once mounted, the tie bolts 22*c* extend through the hitch plate 32 towards the sheave arrangement 22, as shown in FIG. 2.

In a step S9, a suspension medium 4 is inserted (roped) into each sheave 22*a*. The sheaves 22 are adjusted and fastened, as needed. This step is repeated until all suspension media 4 are inserted into the sheaves 22*a*.

In a step S10, the setscrews 40, 40*a* are inserted into the slots 42. The setscrews 40, 40*a* are adjusted to press against the yoke for horizontal positioning of the coupling system 12 with respect to the yoke.

The various components of the coupling system 12 described with reference to FIGS. 2-7 make the coupling system 12 to modular design. The modular design of the coupling system 12 significantly eases the installation process. Each individual component is relatively lightweight and can be handled separately. In one embodiment, each side wall 30 may be formed by individual wall panels. As shown, e.g., in FIGS. 3 and 4, each side wall 30 is formed by four thin and, hence, lightweight wall panels. It is contemplated that the number of individual wall panels may vary depending on certain load requirements.

Furthermore, individual components of the coupling system 12 may be replaced separately, if needed. These components may be selected depending on particular or changing load requirements.

It is apparent that there has been disclosed a system and method for coupling a suspension medium to a load carrying structure of an elevator installation that fully satisfy the objects, means, and advantages set forth herein before. For example, the coupling system 12 serves as an interface between the suspension media 4 and the cabin 2 and is in particular advantageous for modernizing elevator installations where the existing cabin and counterweight is to be retained without any modification. The coupling system 12 with its rotatable hitch plate 32 is designed to accommodate any installation angle on both the cabin and the counterweight side which is due to varying hoistway layouts. In addition, the coupling system 12, due to its rectangular opening (see e.g. FIG. 4) accommodates to a variety of yoke profiles. The interface formed by the coupling system 12 does not require any drilling on-site (e.g. through the yoke) and does not require yoke or cross head modifications.

What is claimed is:

1. A system for coupling a suspension medium to a load carrying structure of an elevator installation, comprising:

a frame having two spaced apart side walls extending in parallel planes, the side walls being interconnected by at least one rod extending through both of the side walls, wherein the side walls are positionable along the at least one rod to receive a part of the load carrying structure between the side walls, and wherein each of the side walls has a receptacle having a predetermined shape; and a hitch plate having a least one fixture configured to couple to a pulley arrangement for the suspension medium, wherein each receptacle is sized to rotatably receive a section of the hitch plate so that the hitch plate extends between the side walls and is rotatable about a vertical axis.

2. The system of claim 1, wherein the hitch plate has a circular shape.

3. The system of claim 2, wherein sections of the circularly shaped hitch plate extend through the receptacles.

4. The system of claim 2, wherein the hitch plate is configured to be rotatable between about 0° and about 360° .

5. The system of claim 1, wherein the at least one fixture includes an opening sized to receive a rod of the pulley arrangement.

6. The system of claim 5, wherein a plurality of the openings is positioned along two straight perpendicular lines:

7. The system of claim 1, further comprising a predetermined number of rods, including the at least one rod, extending between the side walls and interconnecting the side walls.

8. The system of claim 7, wherein each side wall has a corresponding number of passageways, each removably receiving an end section of an associated one of the rods.

9. The system of claim 1, wherein each side wall has an upper part containing the receptacle, and a bottom part having an opening for a crossbeam.

10. The system of claim 1, further comprising first setscrews extending through the hitch plate and configured to press against an upper surface of the support structure for vertical positioning of the system with respect to the load carrying structure, and second setscrews extending through the side walls to press against sides of the support structure for horizontal positioning of the system.

11. The system of claim 10, wherein each setscrew has a bearing surface pressing against the load carrying structure that includes a material selected to dampen vibrations.

12. The system of claim 1, wherein an axis of the hitch plate is substantially parallel with the side walls.

13. An elevator installation, comprising:

a suspension medium;

a sheave arrangement, coupled to the suspension medium;

a load carrying structure; and a coupling system configured to couple the sheave arrangement to the load carrying structure, wherein the coupling system comprises:

a frame having two spaced apart side walls extending in parallel planes, the side walls being interconnected by at least one rod extending through both of the side walls, wherein the side walls are positionable along the at least one rod to receive a part of the load carrying structure between the side walls, and wherein each of the side walls has a receptacle having a predetermined shape; and a hitch plate having a least one fixture configured to couple to the sheave arrangement, wherein each receptacle is sized to rotatably receive a section of the hitch plate so that the hitch plate extends between the side walls and is rotatable about a vertical axis.

14. The installation of claim 13, wherein the hitch plate has a circular shape.

15. The installation of claim 14, wherein sections of the circularly shaped hitch plate extend through the receptacles.

16. The installation of claim 14, wherein the hitch plate is configured to be rotatable between about 0° and about 360° .

17. The installation of claim 13, wherein an axis of the hitch plate is substantially parallel with the side walls.

18. A method of coupling a suspension medium to a load carrying structure of an elevator installation, comprising:

positioning a hitch plate above a part of a load carrying structure;

mounting two side walls to the hitch plate so that sections of the hitch plate are rotatably positioned in receptacles of the side walls and the part of the load carrying structure extends between the side walls, wherein the side walls are opposite each other and extend in parallel planes, the side walls being interconnected by at least one rod extending through both of the side walls to form a frame and the side walls being positionable along the at least one rod; and mounting a sheave arrangement to the hitch plate, wherein the sheave arrangement is configured to receive the suspension medium.

19. The method of claim 18, wherein mounting the side walls includes connecting the side walls by means of rods, including the at least one rod, and inserting a crossbeam into an opening at the bottom and on each side wall, wherein the crossbeam extends underneath the part of the load carrying structure.

20. The method of claim 18, further comprising mounting setscrews to the hitch plate to fix a vertical position of the hitch plate with respect to the part of the load carrying structure, and mounting setscrews to the side walls to fix a horizontal position of the part of the load carrying structure with respect to the sidewalls.

* * * * *